US006454660B1

(12) United States Patent
Brown

(10) Patent No.: US 6,454,660 B1
(45) Date of Patent: Sep. 24, 2002

(54) GOLFING AID

(76) Inventor: Len Trevor Brown, ‰ Kloof and Ridge Drive, Heuwelkruin, Knysna 6570 (ZA)

( * ) Notice: Subject to any disclaimer, the term of this patent is extended or adjusted under 35 U.S.C. 154(b) by 0 days.

(21) Appl. No.: 09/719,038

(22) PCT Filed: Jun. 10, 1999

(86) PCT No.: PCT/ZA99/00042

§ 371 (c)(1),
(2), (4) Date: Dec. 6, 2000

(87) PCT Pub. No.: WO09/64120

PCT Pub. Date: Dec. 16, 1999

(30) Foreign Application Priority Data

Jun. 11, 1998 (ZA) ..... 98/5066

(51) Int. Cl.[7] ..... A63B 69/36
(52) U.S. Cl. ..... 473/229; 473/257
(58) Field of Search ..... 473/219, 226, 473/229, 231, 509, 257, 258, 259, 260, 235; 273/317.2, 108.2; D21/285, 291

(56) References Cited

U.S. PATENT DOCUMENTS

| | | | | | |
|---|---|---|---|---|---|
| 2,655,378 | A | * | 10/1953 | Sheffer | 473/229 |
| 3,595,583 | A | * | 7/1971 | Oppenheimer | 273/DIG. 21 |
| 3,703,294 | A | | 11/1972 | Fitch | |
| 3,876,212 | A | * | 4/1975 | Oppenheimer | 434/252 |
| 4,173,344 | A | | 11/1979 | Angshed | |
| 4,280,701 | A | * | 7/1981 | Beckish | 473/221 |
| 4,653,757 | A | * | 3/1987 | Wilkinson | 473/229 |
| 4,700,949 | A | | 10/1987 | Nottoli | |
| 4,903,968 | A | * | 2/1990 | Hargrave | 473/220 |
| 4,919,433 | A | * | 4/1990 | Millat | 473/258 |
| 5,474,299 | A | | 12/1995 | Romano | |
| 5,478,079 | A | * | 12/1995 | Liberatore et al. | 473/229 |
| 5,628,695 | A | * | 5/1997 | Worthington et al. | 473/229 |
| 5,707,300 | A | * | 1/1998 | May et al. | 473/257 |
| 5,807,185 | A | * | 9/1998 | Raubuck et al. | 124/1 |
| 6,196,933 | B1 | * | 3/2001 | Hope et al. | 473/218 |
| 6,322,456 | B1 | * | 11/2001 | Benggon | 473/219 |

FOREIGN PATENT DOCUMENTS

| | | |
|---|---|---|
| GB | 1174773 | 12/1969 |
| GB | 2104784 A | 3/1983 |
| GB | 2228421 A | 8/1990 |
| WO | 90/15645 | 12/1990 |

* cited by examiner

*Primary Examiner*—Benjamin H. Layno
*Assistant Examiner*—Vishu K Mendiratta
(74) *Attorney, Agent, or Firm*—Head, Johnson and Kachigian

(57) ABSTRACT

The invention provides a golf aid (10) comprising a rectangular tubular frame (11) having a horizontal cross bar (12) which is suitably supported at each end on the remainder of the frame (11). The frame (11) is provided with a support frame, in the from of vertical legs (14) at an angle to the frame (11) and having rearwardly extending feet (16) which imparts stability to the golf aid. Bracing struts (18) extend between the vertical legs and the horizontal feet (16). Extending from the frame are protruding elements, in the form of horizontally protruding arms (38) protruding from the bar (12), and laterally and upwardly protruding arms (39) and (40) protruding from the frame (11). At the centre of the bar (12) there is a slot designated (20). The central part (22) of the slot (20) is relatively narrow when compared with the two tapered end sections of the slot (20) which end sections are designated (24).

12 Claims, 2 Drawing Sheets

GOLFING AID

FIELD OF THE INVENTION

THIS INVENTION relates to an aid for assisting a golfer in improving his game.

BACKGROUND TO THE INVENTION

Golf, more than any other sport, requires that when the ball is struck, it be struck perfectly each time. There is little margin for error. Failure to strike the bail correctly is at least going to result in the ball travelling less than the optimum distance and at worst is going to mean that it will diverge from the intended track so substantially as to fall out of bounds.

The stance of the body, the way in which it moves during swinging of the club, and the path followed by the club all contribute to a perfect swing.

BRIEF DESCRIPTION OF THE INVENTION

According to one aspect of the present invention there is provided a golf aid which includes a horizontal bar, an anchorage attached to the bar and movable along the bar, and a flexible connector for connecting said anchorage to a golf club.

Said bar can be hollow and have an elongate slot therein, said anchorage comprising an element which is within the hollow bar, the flexible connector passing through said slot.

Said slot is preferably wider at its ends than over that portion thereof which lies between the wider ends, said element being too large to pass through the smaller dimension central section of the slot but small enough to emerge from the slot from said end portions.

Said bar may be the cross bar of a substantially rectangular frame.

Said frame may have a support frame positioned or positionable at an angle to the frame for permitting said frame to stand upon a surface, optionally having one or more strut provided between said frame and said support frame.

In one embodiment the support frame is pivotally mounted to the frame to permit the folding and unfolding thereof.

In another embodiment the support frame is removable from the frame.

Said frame can also carry protruding elements, there being friction means for holding said elements in positions in which they protrude from the bar.

Typically, at least some of said elements lie in the path of the club being swung in an arc adjacent the bar.

The frame may be provided with further protruding elements which indicate to a user the correctness of his stance, the parameters of his swing of the golf club and the alignment of his body relative to the ball.

The frame may include upright bars protruding upwardly from the frame.

The upright bars may be configured to assist the user in assuming the correct posture before performing a swing of the golf club. Like wise, the upright bars may assist the user in maintaining the correct posture during and/or after performing the swing.

The upright bar may have one or more strut like projections locatable between the upright bar and the horizontal bar. The strut like projections may be pivotably rotatable about a pivot point located adjacent an end of the upright bar.

The invention extends to a golf aid which includes detecting means for detecting the passage of a portion of a golf club, for example, when it is being swung towards or away from a golf ball.

The detecting means may be in the form of one or more proximity switches configured to detect the metallic portion of a golf club. However, the detecting means may be optical detecting means relying on the absorption or reflection of light by the golf club to detect its passage. Even further, the detecting means may rely on a beam of light being broken by the passage of the golf club between a light emitting and a light receiving portion of the detecting means.

At least some of the detecting means may be positioned on the protruding elements or on the upright bars.

However, some of the detecting means may be positioned on the frame itself or even on additional support platforms connected to said frame or said support frame.

Those skilled in the art will realise that there are may other methods for detecting passage of the golf club during the swing, for example, such as the image system of JVC™ Video Systems 900, 1300 and 2000, which record the users actions and permit analysis thereof and advice thereon.

According to a further aspect of the invention, there is provided a horizontal bar for a golf aid, said horizontal bar including an anchorage attached to the bar and movable along the bar, and a flexible connector for connecting said anchorage to a golf club.

Typically such a horizontal bar would be provided for in D-I-Y format for constructing a golf aid as described above.

According to yet a further aspect of the invention, there is provided a method of aiding a user to achieve the correct posture or position for playing golf, the method including the step of guiding the body of a user between a number of guide points so as to achieve and/or maintain the correct posture or position.

The method may include the step of restricting the displacement of potions of the body of a user within pre-set parameters and, optionally, indicating to the user when those parameters have been violated.

The method may include restraining the body of a user within the pre-set parameters.

BRIEF DESCRIPTION OF THE DRAWINGS

For a better understanding of the present invention, and to show how the same may be carried into effect, reference will now be made, by way of example, to the accompanying drawings in which.

Figure 1:
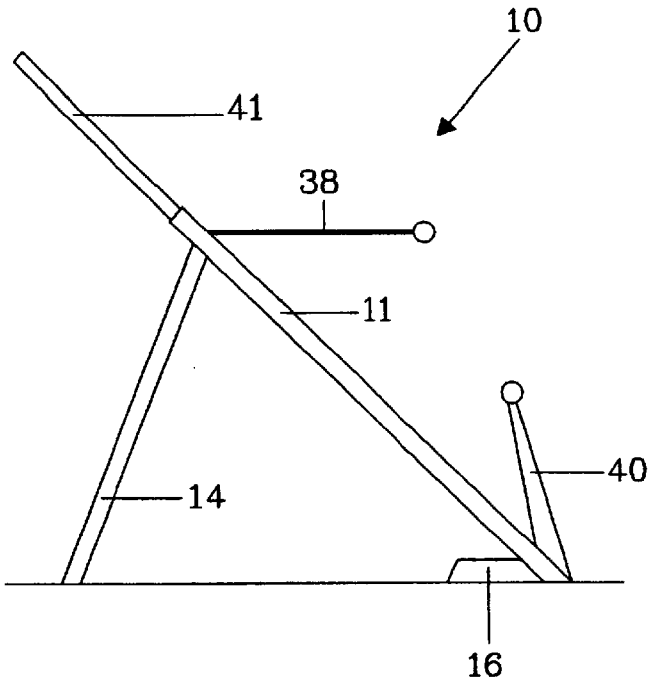
FIG. 1 is a pictorial side view of a golf aid in accordance with the present invention.
Figure 2:
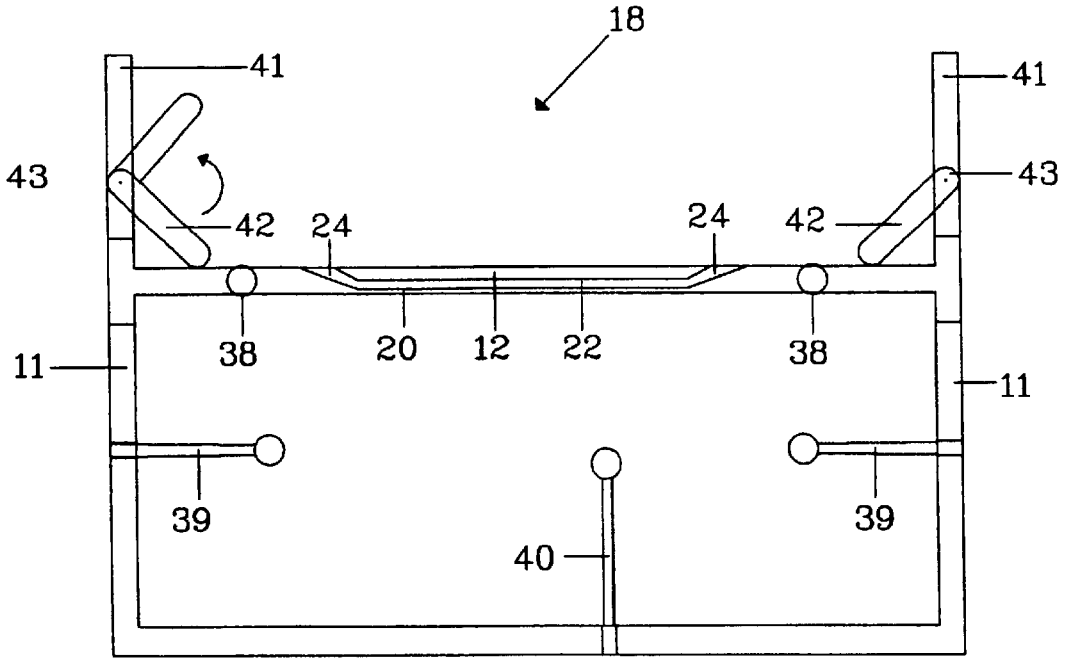
FIG. 2 is a pictorial front view of a golf aid in accordance with the present invention.

Referring firstly to FIGS. 1 and 2, the golf aid 10 illustrated comprises a rectangular tubular frame 11 having a horizontal cross bar 12 which is suitably supported at each end on the remainder of the frame 11. In the illustrated embodiment frame 11 is provided with a support frame, in the from of vertical legs 14 at an angle to the frame 11 and having rearwardly extending feet 16 which imparts stability to the golf aid.

Extending from the frame are protruding elements, in the form of horizontally protruding arms 38 protruding from the bar 12, and laterally and upwardly protruding arms 39 and 40 protruding from the frame 11 for indicate to a user the correctness of his stance, the parameters of his swing of a golf club 33 and the alignment of his body relative to the ball.

The frame 11 has upright bars 41 protruding upwardly from the frame 11. The upright bars 41 are be configured to assist the user in assuming the correct posture before performing a swing of the golf club by aligning his shoulders therewith. Likewise, the upright bars 41 may assist the user in maintaining the correct posture during and/or after performing the swing.

The upright bars have strut like projections 42 locatable between the upright bars 41 and the horizontal bar 12. The strut like projections 42 are pivotably rotatable about a pivot point 43 located adjacent an end of the upright bar 41.

Figure 3:
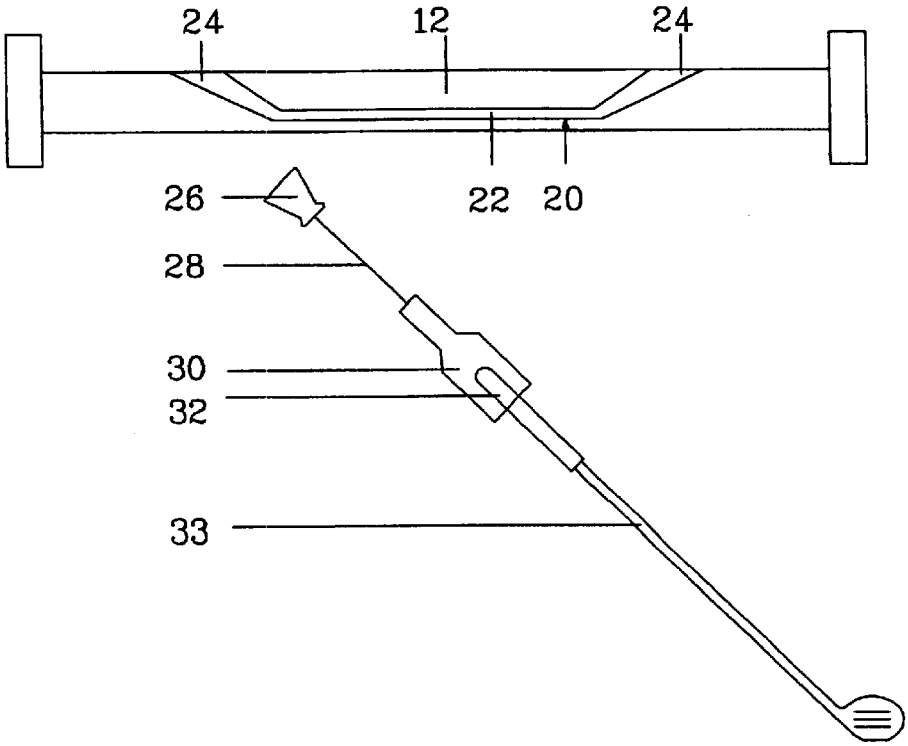
FIG. 3 illustrates a bar of the golf aid in more detail.

As can be further seen with reference to FIG. 3 (as well as FIGS. 1 and 2), at the centre of the bar 12 there is a slot designated 20. The central part 22 of the slot 20 is relatively narrow when compared with the two tapered end sections of the slot 20 which end sections are designated 24. The central part 22 of the slot is straight and extends along the front face of the bar 12. At each end the central part 22 curves upwardly and rearwardly to join the end sections 24 which are in the rear face of the bar 12.

Within the hollow bar 12 there is an element 26 which is preferably in the form of a sphere or a cone. The element 26 is too large to pass through the central part 22 of the slot 20 but small enough to pass through the end sections 24.

A flexible connector in the form of a cord 28 has one end attached to the element 26. At the other end of the cord 28 there is a plug or pocket 30 which can be releasably connected to a socket or plug 32 connected to the golf club 33.

In use the golfer stands on one side of the bar 12 with his arms and the club on the other side of the bar. The socket or plug 30 attached to the cord 28 is secured to the plug or socket 32 attached to the golf club 33. The element 26 is free to move along the interior of the bar 12. The cord 28 emerges from the interior of the bar 12 through the slot 20.

Under the tuition of a golf professional, or working alone, the aid can be used to position and restrain the golfer's body and the club so that the correct swing is achieved. If the follow through is correct the element 26 travels along the slot 20 to the wider end section 24 and emerges from the bar through the wider end section 24 of the slot 20. If the element 26 does not emerge from the slot 20 then the club is not in the right position and the swing was improperly executed.

Figure 4:
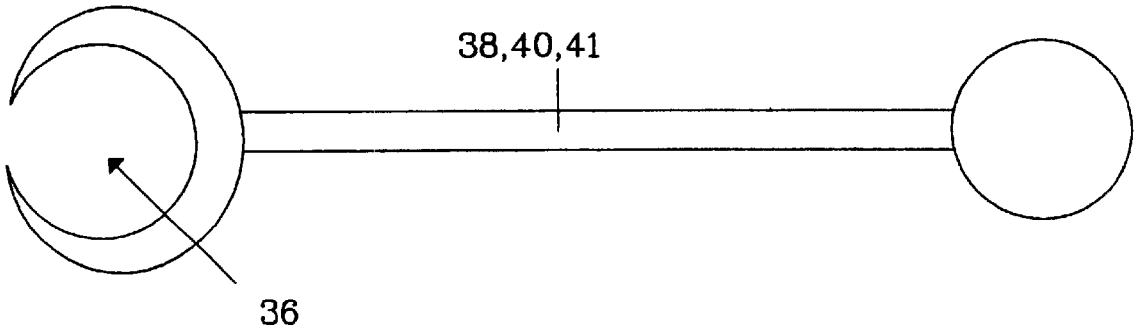
FIG. 4 shows the friction clamps for maintaining the protruding elements on the frame.

As can be seen from FIG. 4, the protruding elements 38, 40 and 41 are attached to the bar 12 by connections in the form of a c-clamp 36 made from resiliently deformable material, the opening of the c-clamp being complementary to the dimensions of the bar 12 for attachment to the bar 12, are provided one on each side of the slot 20, and towards the end of the bar 12. Protruding from each c-clamp 36 is an arm 38 which is connected to the c-clamp 36. The friction between the c-clamp 36 and the bar 12 is sufficient to ensure that the arm 38 remains in the position to which it is adjusted. Similar rings are used to attach the other arms 40 and 41 to the frame 11.

When the club 33 is swung in an arc, either in back swing or down swing, the club encounters one or other arm 38 displacing it from, say, a horizontal position to a position in which it is inclined upwardly or inclined downwardly. The fact that the club displaces the arm is an indicated that the club travelled along the correct path. If the arms are not struck by the club then this is an indication that the club was off line when it crossed the horizontal plane containing the axis of the bar 12.

What is claimed is:

1. A golf swing training apparatus which includes:

a horizontal bar mounted on a support frame, wherein said bar is at least partially hollow and has an elongate slot therein which is wider at its end portions than over that portion thereof which lies between the ends, an anchorage attached to the horizontal bar and movable along the horizontal bar, said anchorage including an element which is within said hollow bar and being too large to pass through the smaller dimension central portion of the slot but small enough to emerge from the slot at said end portions, and flexible connector means for connecting said anchorage to a golf club, which flexible connector means includes a cord and permits said golf club to move through a range of motion in an arc.

2. A golf swing training apparatus as claimed in claim 1, including protruding elements extending away from the horizontal bar and support frame into the path of the club being swung in an arc adjacent the horizontal bar and provided to indicate to a user the correctness of his stance, they parameters of his swing of the golf club and/or the alignment of his body relative to the ball.

3. A golf swing training apparatus as claimed in claim 2, which includes detecting means for detecting the passage of a portion of a golf club.

4. A golf swing training apparatus as claimed in claim 3, wherein at least some of the detecting means are positioned on the protruding elements.

5. A golf swing training apparatus as claimed in claim 1, including upright bars extending upwardly away from the horizontal bar to, in use, indicate to the user the correctness of the back swing.

6. A golf swing training apparatus as claimed in claim 5, which includes detecting means for detecting the passage of a portion of a golf club.

7. A golf swing training apparatus as claimed in claim 6, wherein the detecting means is optical detecting means relying on the absorption or reflection of light by the golf club to detect its passage.

8. A golf swing training apparatus as claimed in claim 6, wherein at least some of the detecting means are positioned on said upright bars.

9. A golf swing training apparatus as claimed in claim 1, which includes detecting means for detecting the passage of a portion of a golf club.

10. A golf swing training apparatus as claimed in claim 9, wherein the detecting means are in the form of one or more proximity switches configured to detect the proximity of a metallic portion of a golf club.

11. A golf swing training apparatus as claimed in claim 9, wherein the detecting means is optical detecting means relying on the absorption or reflection of light by the golf club to detect its passage.

12. A golf swing training apparatus as claimed in claim 9, wherein the detecting means relies on a beam of light being broken by the passage of the golf club between a light emitting and a light receiving portion of the detecting means.

* * * * *